US011408057B2

(12) United States Patent
Couvrat et al.

(10) Patent No.: US 11,408,057 B2
(45) Date of Patent: Aug. 9, 2022

(54) AUSTENITIC ALLOY WITH HIGH ALUMINUM CONTENT AND ASSOCIATED DESIGN PROCESS

(71) Applicants: Manoir Pitres, Paris (FR); Université de Rouen Normandie, Mont Saint Aignan (FR); Centre National de la Recherche Scientifique, Paris (FR); Institut National des Sciences Appliquées Rouen Normandie, Saint-Etienne-du-Rouvray (FR)

(72) Inventors: Mathieu Couvrat, Pitres (FR); Antoine Facco, Rouen (FR); Cristelle Pareige, Rouen (FR)

(73) Assignees: Manoir Pitres, Paris (FR); Université de Rouen Normandie, Mont Saint Aignan (FR); Centre National de la Recherche Scientifique, Paris (FR); Institut National des Sciences Appliquées Rouen Normandie, Saint-Etienne-du-Rouvray (FR)

( * ) Notice: Subject to any disclaimer, the term of this patent is extended or adjusted under 35 U.S.C. 154(b) by 191 days.

(21) Appl. No.: 16/435,265

(22) Filed: Jun. 7, 2019

(65) Prior Publication Data

US 2019/0376164 A1 Dec. 12, 2019

(30) Foreign Application Priority Data

Jun. 7, 2018 (FR) ..... 1854938

(51) Int. Cl.

| | |
|---|---|
| ***C22C 19/05*** | (2006.01) |
| ***C22F 1/10*** | (2006.01) |
| ***C22C 38/44*** | (2006.01) |
| ***C22C 38/48*** | (2006.01) |
| ***C22C 38/50*** | (2006.01) |

(52) U.S. Cl.
CPC ..... *C22C 19/051* (2013.01); *C22C 38/44* (2013.01); *C22C 38/48* (2013.01); *C22C 38/50* (2013.01)

(58) Field of Classification Search
CPC ..... C22C 19/055; C22C 38/44; C22C 38/50; C22C 19/053; C22C 30/00; C21D 6/004; C22F 1/10
See application file for complete search history.

(56) References Cited

U.S. PATENT DOCUMENTS

| | | | |
|---|---|---|---|
| 3,984,239 | A | 10/1976 | Petersen |
| 4,119,765 | A | 10/1978 | Pinnow et al. |
| 4,248,629 | A | 2/1981 | Pons et al. |
| 2019/0345592 | A1 | 11/2019 | Hashimoto et al. |

FOREIGN PATENT DOCUMENTS

| | | | | |
|---|---|---|---|---|
| CA | 2740160 | A1 * | 4/2010 | ..... C22C 30/00 |
| EP | 0502654 | A1 | 9/1992 | |
| EP | 0502656 | A1 | 9/1992 | |
| EP | 0976844 | A2 | 2/2000 | |
| EP | 3239311 | A1 | 11/2017 | |
| EP | 3330390 | A1 | 6/2018 | |
| FR | 2307049 | A1 | 11/1976 | |
| FR | 2349659 | A1 | 11/1977 | |
| FR | 2333870 | B1 | 6/1979 | |
| JP | 06-002061 | A | 1/1994 | |
| WO | WO-0034541 | A1 * | 6/2000 | ..... C22C 19/058 |
| WO | 2004/042101 | A2 | 5/2004 | |
| WO | 2010/043375 | A1 | 4/2010 | |

OTHER PUBLICATIONS

ASM International, Materials Park, Ohio, ASM Specialty Handbook: Nickel, Cobalt and Their Alloys, "Metallography, Microstructure, and Phase Diagrams of Nickel and Nickel Alloys", Dec. 2000, pp. 302-304.*
European Extended Search Report and Opinion for European Application No. 19179103, dated Oct. 17, 2019, 8 pages.
Comparison Table, Jan. 29, 2020 (1 page).
Third Party Observation of Application No. EP20190179103 dated Jan. 29, 2020, 3 pages.

* cited by examiner

*Primary Examiner* — Jessee R Roe
(74) *Attorney, Agent, or Firm* — TraskBritt

(57) ABSTRACT

An austenitic alloy based on nickel, chromium and iron, and having a high aluminum content, intended for use at a given operating temperature (Ts) between 900° C. and 1200° C., the alloy comprising the following elements, in weight percent: chromium between 20% and 32%, nickel between 30% and 60%, aluminum between 3.5% and 6%, carbon between 0.4% and 0.7%, titanium between 0.05% and 0.3%, niobium and/or tantalum between 0.6% and 2%, an element, composed of at least one rare earth and/or hafnium, between 0.002% and 0.1%, silicon between 0 and 0.5%, manganese between 0 and 0.5%, tungsten between 0 and 2%, and iron as the balance of the elements in the alloy. The alloy has less than 1% by volume of an intermetallic B2-NiAl phase and less than 1% by volume of an alpha prime phase rich in chromium, after subjecting the alloy to an operating temperature (Ts).

16 Claims, 6 Drawing Sheets

| Element in weight % | C | Mn | Si | Ni | Cr | Nb | Al | Ti | Y, Ce, Hf | Fe | Time to rupture (h) | Tmax (alpha prime) (°C) | Tmax (B2-NiAl) (°C) | Status for Ts-950°C | Status for Ts=1050°C |
|---|---|---|---|---|---|---|---|---|---|---|---|---|---|---|---|
| **Alloy 1** | 0.43 | 0.1 | 0.3 | 46.3 | 25.8 | 0.8 | 3.5 | 0.1 | 0.005 | Bal. | **1351** | **822.1** | **878.6** | **ok** | **ok** |
| **Alloy 2** | 0.43 | 0.1 | 0.4 | 46.5 | 25.8 | 0.8 | 3.8 | 0.1 | 0.005 | Bal. | **1280** | **906** | **895** | **ok** | **ok** |
| **Alloy 3** | 0.44 | 0.1 | 0.4 | 40.0 | 31.4 | 0.9 | 4.0 | 0.1 | 0.005 | Bal. | 500 | 1079.6 | 1158.3 | not ok | not ok |
| **Alloy 4** | 0.44 | 0.1 | 0.3 | 46.7 | 26.0 | 0.8 | 4.1 | 0.1 | 0.005 | Bal. | **1066** | **961.9** | **907.1** | not ok | **ok** |
| **Alloy 5** | 0.43 | 0.1 | 0.4 | 44.7 | 30.8 | 0.9 | 4.5 | 0.1 | 0.005 | Bal. | 294 | 1127.8 | 1098.4 | not ok | not ok |
| **Alloy 6** | 0.46 | 0.1 | 0.3 | 44.8 | 31.8 | 0.7 | 4.8 | 0.1 | 0.005 | Bal. | 136 | 1175.2 | 1120.1 | not ok | not ok |
| **Alloy 7** | 0.45 | 0.1 | 0.3 | 55.0 | 25 | 0.9 | 5.0 | 0.1 | 0.005 | Bal. | **1000** | **988.2** | **858.7** | not ok | **ok** |
| **Alloy 8** | 0.43 | 0.1 | 0.4 | 44.2 | 23.1 | 1.1 | 5.6 | 0.1 | 0.005 | Bal. | 47 | 1255.2 | 961.2 | not ok | not ok |
| Ref. | 0.45 | 1.3 | 1.3 | 45 | 35 | 0.7 | - | 0.08 | - | Bal. | 1095 | - | - | - | - |

AUSTENITIC ALLOY WITH HIGH ALUMINUM CONTENT AND ASSOCIATED DESIGN PROCESS

PRIORITY CLAIM

This application is claims the benefit of the filing date of French Patent Application FR1854938, filed Jun. 7, 2018, for "Austenitic Alloy With High Aluminum Content and Associated Design Process."

TECHNICAL FIELD

The present invention concerns the field of austenitic alloys requiring good mechanical and environmental resistance at high temperatures, in particular for use in steam cracking furnaces in the petrochemical industry. It concerns, in particular, an austenitic alloy with a high aluminum content, which has excellent resistance to corrosion and creep at temperatures above 900° C.

BACKGROUND

Austenitic alloys based on nickel, chromium and iron, commonly referred to as "refractory" alloys, have been known for many years for their applications at very high temperatures (see in particular French Patent No. FR2333870). To increase their resistance to the environment, and in particular to carburization and oxidation, it was proposed to add aluminum as disclosed in U.S. Pat. No. 4,248,629. Due to the formation of an aluminum oxide layer on its surface, the alloy then exhibits excellent resistance to carburization and oxidation in a very high temperature environment.

However, it has been observed that the increase in the aluminum content beyond 2-3% by mass adversely affects the creep resistance of the alloy.

The current performance of refractory alloys in a harsh environment, at temperatures above 900° C., limits the achievable yields in the applications for which they are used, as well as the service life of the equipment in question (such as a steam cracking furnace tube, for example). On the one hand, environmental stresses involving coking, carburizing, oxidation or nitriding limit the maximum operating time or temperature applicable; on the other hand, mechanical stresses cause deformation and damage to alloys, which must be contained at deformation rates low enough to ensure a sufficiently long service life of the equipment.

It would, therefore, be desirable to have an austenitic alloy with a high aluminum content to ensure high environmental resistance (corrosion by carburization, oxidation or nitriding) while guaranteeing creep resistance at least as high as currently known alloys, containing little (typically less than 3%) or no aluminum.

BRIEF SUMMARY

This present disclosure proposes a solution to achieve the above objectives. The present disclosure concerns an austenitic alloy with a high aluminum content, which has excellent environmental and creep resistance at temperatures of 900° C. or more. The present disclosure also concerns a process for the formation of such an alloy.

As used herein, the phrase "between X and Y," wherein X and Y constitute endpoint values in a range of values, it is meant "from X to Y," such that the range includes the endpoints X and Y. For example, when an alloy may comprise aluminum between 3.5% and 6%, the alloy may comprise 3.5% aluminum, 6% aluminum, or any percentage of aluminum between 3.5% and 6%.

The present disclosure concerns an austenitic alloy based on nickel, chromium and iron, and with a high aluminum content, intended for use at a given operating temperature between 900° C. and 1200° C., the alloy comprising the following elements in weight percentages:

- chromium between 20% and 32%,
- nickel between 30% and 60%,
- aluminum between 3.5% and 6%,
- carbon between 0.4% and 0.7%,
- titanium between 0.05% and 0.3%,
- niobium and/or tantalum between 0.6% and 2%,
- an element, composed of at least one rare earth and/or of hafnium, between 0.002% and 0.1%,
- silicon between 0 and 0.5%,
- manganese between 0 and 0.5%,
- tungsten between 0 and 2%,
- iron as a balance of the elements in the alloy;

In addition, the alloy has less than 1% by volume of an intermetallic B2-NiAl phase and less than 1% by volume of an alpha prime phase rich in chromium, after the operating temperature has been applied.

According to other advantageous and non-limiting characteristics of the present disclosure, taken either separately or in any technically feasible combination:

- the mass percentages of aluminum $x_{Al}$, nickel $x_{Ni}$, chromium $x_{Cr}$, titanium $x_{Ti}$, carbon $x_C$, niobium $x_{Nb}$, tantalum $x_{Ta}$, silicon $x_{Si}$ and manganese $x_{Mn}$ satisfy the two following relationships (R3, R4):

$$-28.3x_{Al}^2+455.4x_{Al}-0.32x_{Ni}^2+15.3x_{Ni}-0.22x_{Cr}^2+20.7x_{Cr}+121x_{Si}+27x_{Mn}+16x_{Ti}+12x_{Nb}+16x_{Ta}-45x_C-866\leq Ts; \quad (R3)$$

and $$1.8x_{Al}^2+38.3x_{Al}+0.42x_{Ni}^2-51.2x_{Ni}+27.8x_{Cr}+34x_{Si}+8x_{Mn}+89x_{Ti}+39x_{Nb}+22x_{Ta}-334x_C+1572\leq Ts, \quad (R4)$$

where Ts represents the operating temperature;
- the nickel weight percentage $x_{Ni}$ is defined by solving the second degree equations (E3, E4), resulting from the relationships (R3, R4) linking the weight percentages of the alloy elements and the operating temperature;
- the nickel weight percentage $x_{Ni}$ is between a value (X), greater than 30%, consisting of the largest value between the solutions (X', X") of equations (E3, E4), and a value increased by ten points (X+10);
- the sum of the percentages of niobium and tantalum, when both elements are present, is greater than 0.6% and less than or equal to 2%;
- the weight percentage of aluminum in the alloy is greater than 3.8% or even greater than 4%;
- the weight percentage of chromium in the alloy is less than 30% or even less than 28%;
- the total weight percentage of rare earth(s) and/or hafnium in the alloy is between 0.002% and 0.05%.

The invention also concerns a process for designing and forming an austenitic alloy based on nickel, chromium and iron, and with a high aluminum content for use at a given operating temperature between 900° C. and 1200° C.; the alloy comprising the following elements in weight percent:

- chromium between 20% and 32%,
- nickel between 30% and 60%,
- aluminum between 3.5% and 6%,
- carbon between 0.4% and 0.7%,
- titanium between 0.05% and 0.3%, niobium and/or tantalum between 0.6 and 2%, an element, composed of at least one rare earth and/or of hafnium, between 0.002% and 0.1%, silicon between 0 and 0.5%, manganese between 0 and 0.5%, tungsten between 0 and 2%, iron as a balance of the elements in the alloy;

The process comprises selecting the respective weight percentages of aluminum $x_{Al}$, nickel $x_{Ni}$, chromium $x_{Cr}$, titanium $x_{Ti}$, carbon $x_C$, niobium $x_{Nb}$, tantalum $x_{Ta}$, silicon $x_{Si}$ and manganese $x_{Mn}$, so that the alloy has less than 1% by volume of an intermetallic phase B2-NiAl and less than 1% by volume of an alpha prime phase rich in chromium, after the operating temperature has been applied.

According to other advantageous and non-limiting characteristics of the disclosure, taken either separately or in any technically feasible combination:

the mass percentages of aluminum $x_{Al}$, nickel $x_{Ni}$, chromium $x_{Cr}$, titanium $x_{Ti}$, carbon $x_C$, niobium $x_{Nb}$, tantalum $x_{Ta}$, silicon $x_{Si}$ and manganese $x_{Mn}$ satisfy the two following relationships (R3, R4):

$$-28.3x_{Al}^2+455.4x_{Al}-0.32x_{Ni}^2+15.3x_{Ni}-0.22x_{Cr}^2+20.7x_{Cr}+121x_{Si}+27x_{Mn}+16x_{Ti}+12x_{Nb}+16x_{Ta}-45x_C-866\leq Ts; \quad (R3)$$

and $$1.8x_{Al}^2+38.3x_{Al}+0.42x_{Ni}^2-51.2x_{Ni}+27.8x_{Cr}+34x_{Si}+8x_{Mn}+89x_{Ti}+39x_{Nb}+22x_{Ta}-334x_C+1572\leq Ts, \quad (R4)$$

where Ts represents the operating temperature;

the nickel weight percentage $x_{Ni}$ is defined by solving the second degree equations (E3, E4), resulting from the relationships (R3, R4) linking the weight percentages of the alloy elements and the operating temperature;

the nickel weight percentage $x_{Ni}$ is between a value (X), greater than 30%, consisting of the largest value between the solutions (X', X") of equations (E3, E4), and a value increased by ten points (X+10);

the weight percentage of aluminum in the alloy is greater than 3.8% or even greater than 4%.

BRIEF DESCRIPTION OF THE DRAWINGS

Further characteristics and advantages of the disclosure will be clear from the following detailed description, made in reference to the accompanying figures, wherein.

DETAILED DESCRIPTION

The present disclosure concerns an austenitic alloy based on nickel, chromium and iron, with a high aluminum content, intended for use at an operating temperature Ts between 900° C. and 1200° C., such as 1000° C., for example.

It should be noted that the austenitic alloy according to the invention could be used at operating temperatures below 900° C., but would not have, in these temperature ranges, a significant advantage over a standard alloy containing little or no aluminum.

The alloy comprises the following elements, their amount in the alloy being expressed in weight percentage:

chromium between 20% and 32%, nickel between 30% and 60%, aluminum between 3.5% and 6%, carbon between 0.4% and 0.7%, titanium between 0.05% and 0.3%, niobium and/or tantalum between 0.6 and 2%, an element, composed of at least one rare earth and/or of hafnium, between 0.002% and 0.1%, silicon between 0 and 0.5%, manganese between 0 and 0.5%, tungsten between 0 and 2%, iron as a balance of the elements in the alloy.

In the following description, the terms "content," "quantity" or "percentage" in the case of an element of the alloy shall be interpreted as referring to the "weight percentage" of the element.

In the alloy according to the disclosure, a minimum of 20% chromium is required to ensure good corrosion resistance and to allow the formation of chromium carbides, which positively impact the creep resistance of the alloy. The maximum weight percentage of chromium is limited to 32%, in particular to limit the integration of alphagenic elements that tend to destabilize the austenitic structure of the alloy.

Figure 5:
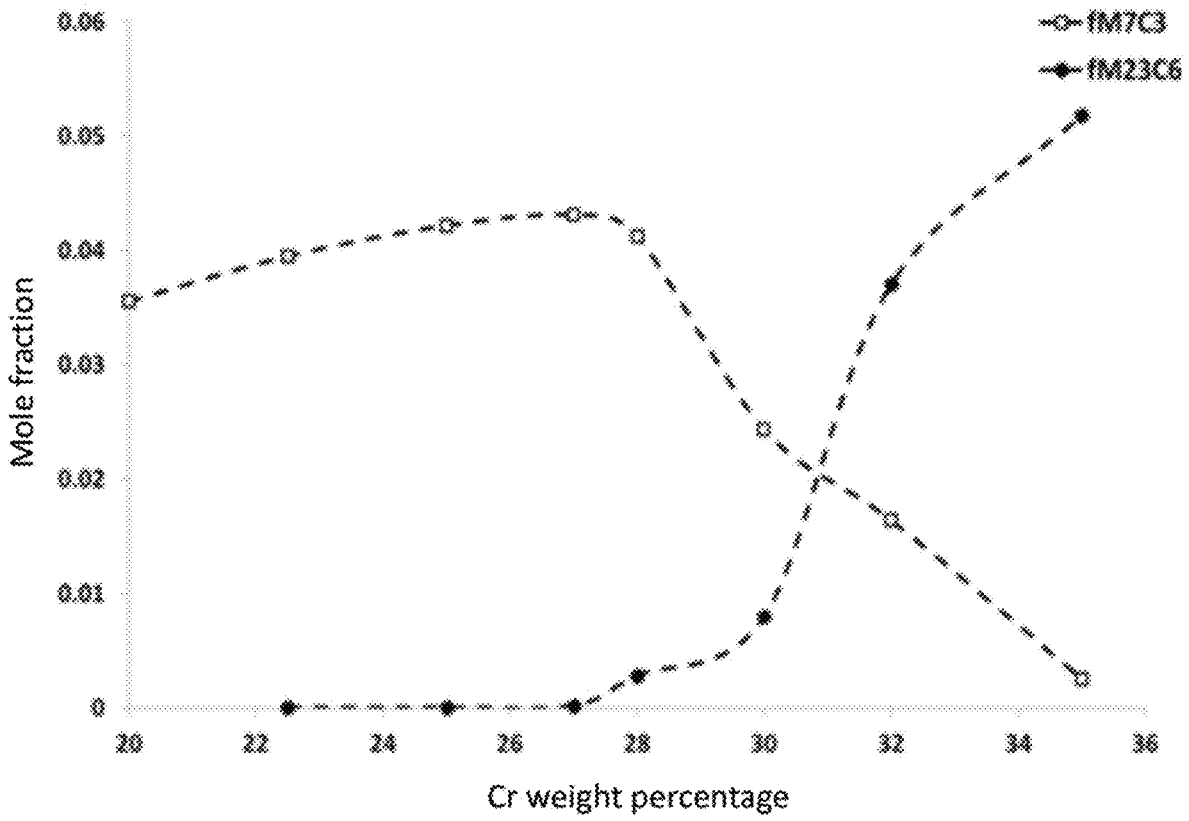
FIG. 5 shows the molar fractions of the primary carbides $M_7C_3$ and $M_{23}C_6$ after solidification of the alloy, as a function of chromium content.

In addition, it should be noted that the type of primary carbides ($M_7C_3$ or $M_{23}C_6$), which predominate after solidification of the alloy, varies according to the chromium content, as shown in FIG. 5. It can be seen that the molar fraction of primary carbides $M_7C_3$ passes through an optimum for a chromium content between 23% and 28%, then decreases, while the molar fraction of primary carbides $M_{23}C_6$ increases significantly beyond a chromium content of about 30%. Advantageously, the weight percentage of chromium is thus kept below 30% or even below 28%, in order to guarantee a majority fraction of primary carbides of the $M_7C_3$ type after solidification of the alloy, which make it possible to obtain a fine and homogeneous dispersion of secondary carbides of the $M_{23}C_6$ type (resulting from the transformation of primary carbides $M_7C_3$ during high temperature cycles). Such a dispersion of secondary precipitates $M_{23}C_6$ (finer and more evenly distributed than primary carbides $M_{23}C_6$) provides improved creep properties to the alloy.

The minimum nickel weight percentage is defined at 30% in order to maintain a refractory alloy with an austenitic structure, the alloy containing at least 20% chromium and other alphagenic elements that tend to destabilize the austenitic structure in favor of a ferritic structure. The quantity of nickel is limited to 60% or even 55% for economic reasons, nickel being a major cost contributor.

Advantageously, the nickel content range can be defined to a target just necessary, to avoid the formation of harmful phases at operating temperature Ts while keeping costs under control, as will be described below.

The weight percentage of carbon is defined at a minimum of 0.4% to allow the formation in the alloy of a significant volume fraction of carbides, the carbides reinforcing the creep resistance of the alloy. The maximum percentage is set at 0.7% in order to maintain sufficient ductility for the use of the material, the reinforcement by carbides also having the effect of reducing ductility.

Titanium has a strong impact on the formation of finer and more evenly distributed carbides in the alloy: it is particularly effective at low contents, called micro additions. It is included in the alloy in a weight percentage ranging from 0.05% to 0.3%.

Niobium and/or tantalum, each in proportions ranging from 0.6% to 2%, are added to the alloy. These two elements also contribute to the formation of carbides. Advantageously, when both elements are present in the alloy, the sum of the mass percentages of niobium and tantalum is greater than 0.6% and less than or equal to 2%.

Aluminum is present in the alloy at a high content, between 3.5% and 6%. Such a content allows the formation of a continuous aluminum oxide layer on the surface of the alloy in a wide range of oxygen partial pressures (from less than 5 particles per million to high partial pressures such as under air), and a wide range of temperatures (from intermediate temperatures around 800° C. to temperatures above 1200° C.). The aluminum oxide surface layer then forms a very resistant and effective barrier to corrosion (oxidation, carburization, nitriding, etc.) of the alloy at high temperatures, typically 900° C. and above.

Advantageously, the weight percentage of aluminum is greater than or equal to 3.8%, or even 4%. A high aluminum content ensures the formation of an aluminum oxide layer under a wider range of environmental conditions. It also provides access to a larger aluminum "tank" and thus preserves the properties of the alloy over longer periods of time, in very harsh environments where layers of aluminum oxides are consumed.

The addition of an element composed of at least one rare earth element (such as yttrium, cerium) and/or of hafnium is beneficial to the growth and adhesion of the aluminum oxide layer to the alloy surface. The total quantity of this element is set at a minimum of 0.002%. A quantity greater than 0.1% does not provide any additional effect, although it has a strong impact on cost; it can even be harmful to mechanical properties, including mechanical resistance at high temperatures. Advantageously, the total content of rare earth elements(s) and/or hafnium is limited to 0.05% or less, or even limited to 0.01% or less.

The alloy may optionally contain silicon, to promote flow during casting of the alloy and enhance its corrosion resistance. The quantity of silicon is nevertheless limited to 0.5% or less to avoid negatively impacting the creep resistance of the alloy.

The alloy may also contain manganese, but in a weight percentage of less than 0.5% to avoid or limit the formation of manganese and chromium spinel oxide, which has very fast formation kinetics but is less stable and protective than chromium oxide and even more so than aluminum oxide.

The alloy may optionally contain tungsten, which plays a minor role in improving mechanical properties at high temperatures by transforming chromium carbides by enriching them with tungsten, and by hardening by solid solution. This element is limited to 2% or less because too much tungsten in chromium carbides will cause them to lose their stability and hardening role at high temperatures.

Finally, the alloy contains iron, in a percentage that completes the composition of the alloy, so that the sum of the weight percentages of the elements reaches 100%.

Of course, the alloy can also include other elements conventionally used at low contents in steel, these elements being found in particular in raw materials or in the manufacturing steps. At low content, these elements have little impact and no particular need. Elements such as molybdenum or copper are found at contents below 0.5%. The alloy may possibly be contaminated by trace impurities in the order of one particle per million to one hundred particles per million, such as phosphorus, sulphur, lead, tin, etc.

As mentioned in the introduction, it is common for an austenitic alloy with a high aluminum content, correlated with excellent corrosion resistance, to show a deterioration in creep resistance above a weight percentage of aluminum in the order of 3%.

Thus, going beyond the role of each individual element of the alloy, the applicant studied the relationship between the microstructure of the alloy and its mechanical properties at or above operating temperature. The operating temperature is the temperature to which the alloy is intended to be subjected during its use: for example, for an alloy forming a steam cracking furnace tube, the operating temperature may be between 950° C. and 1150° C.

These studies, based in particular on scanning electron microscopy (SEM) or transmission electron microscopy (TEM) characterizations and creep tests, have shown that the creep properties of the high aluminum alloy (Al content greater than or equal to 3.5%) are directly impacted by the precipitation of a B2-NiAl intermetallic phase and/or of an alpha prime phase (of centered cubic crystallographic structure) rich in chromium at the operating temperature Ts.

As a reminder, B2 according to the Strukturbericht notation qualifies a phase comprising two types of atoms (in this case, Ni and Al) in equal proportion and whose crystallographic structure is "primitive interpenetrated cubic," i.e., each of the two types of atom forms a simple centered cubic lattice, with an atom of one type in the center of each cube of the other type. Note that, in this case, the B2-NiAl phase is not necessarily stoichiometric, Al sites can eventually be replaced by Cr or Fe atoms.

Thus, the applicant was able to determine that, in an austenitic alloy with a high aluminum content, the creep resistance at operating temperature Ts decreases with the increase in the volume fraction of the B2-NiAl phase in the alloy raised to this temperature. The same applies to the increase in the volume fraction of alpha prime phases.

Based on these observations, a characteristic of the austenitic alloy according to the present disclosure is that it has less than 1% by volume of an intermetallic B2-NiAl phase and less than 1% by volume of an alpha prime phase rich in chromium, after the operating temperature Ts has been applied to it for a few hours, typically for more than 10 hours. Preferably, the alloy according to the present disclosure has less than 0.5% by volume of each of the B2-NiAl and alpha prime phases, or even less than 0.2% by volume. The fact that the austenitic alloy contains a very low volume fraction of B2-NiAl and alpha prime phases ensures that the austenitic alloy with a high aluminum content has excellent creep resistance and excellent environmental (corrosion) resistance.

The presence of a very small volume fraction of B2-NiAl and alpha prime phases in the alloy or their absence, after the operating temperature Ts has been applied to it, may be verified experimentally on a sample (e.g., by scanning electron or transmission electron microscopy) or, as proposed below, anticipated during the design of the alloy or verified from the composition of the alloy.

Based on correlations between the physical characterizations and CALPHAD simulations (phase diagram calculations, making it possible to predict the phases present in the alloy at temperature equilibrium, depending on its composition), two relationships R1, R2 were established between the weight percentages of certain elements in the alloy and the maximum temperature of the stability domain of the B2-NiAl (R1) and the alpha prime phase (R2) respectively:

$$T_{max}^{B2\text{-}NiAl}(^\circ\text{ C.})=-28.3x_{Al}^2+455.4x_{Al}-0.32x_{Ni}^2+15.3x_{Ni}-0.22x_{Cr}^2+20.7x_{Cr}+121x_{Si}+27x_{Mn}+16x_{Ti}+12x_{Nb}+16x_{Ta}-45x_C-866, \quad (R1)$$

and $$T_{max}^{\alpha'}(^\circ\text{ C.})=1.8x_{Al}^2+38.3x_{Al}+0.42x_{Ni}^2-51.2x_{Ni}+27.8x_{Cr}+34x_{Si}+8x_{Mn}+89x_{Ti}+39x_{Nb}+22x_{Ta}-334x_C+1572. \quad (R2)$$

The weight percentages in the alloy of aluminum $x_{Al}$, nickel $x_{Ni}$, chromium $x_{Cr}$, titanium $x_{Ti}$, carbon $x_C$, niobium $x_{Nb}$, tantalum $x_{Ta}$ (when present) silicon $x_{Si}$ and manganese $x_{Mn}$, are related to $T_{max}^{B2\text{-}NiAl}$ and $T_{max}^{\alpha'}$, the maximum temperatures of the stability domain respectively of the intermetallic phase B2-NiAl and the alpha prime phase, in the alloy. The maximum temperatures of the stability range can be seen as the limit temperatures below which formation occurs in the alloy of the B2-NiAl and alpha prime phases, over a temperature range corresponding to the stability range of each phase.

These relationships are valid for weight percentages of the elements within the ranges previously defined for the alloy according to the present disclosure.

It appears that the elements Al, Cr, Si, Mn, Ti, Nb and Ta tend to increase the maximum temperatures $T_{max}^{B2\text{-}NiAl}$ and $T_{max}^{\alpha'}$ of the stability domain of the B2-NiAl and alpha prime phases (in other words, they tend to expand their domain of existence toward the higher temperatures); the Ni and C elements tend to decrease the maximum temperatures $T_{max}^{B2\text{-}NiAl}$ and $T_{max}^{\alpha'}$ of the stability domain of the B2-NiAl and alpha prime phases.

Advantageously, the operating temperature Ts must be higher than the maximum temperatures $T_{max}^{B2\text{-}NiAl}$ and $T_{max}^{\alpha'}$ of the stability domains of the B2-NiAl phase and the alpha prime phase, so that the alloy, when subjected to Ts in use, has no or very few intermetallic B2-NiAl and/or alpha prime phase precipitates, which could reduce its creep resistance.

According to an advantageous embodiment of the invention, the weight percentages of aluminum $x_{Al}$, nickel $x_{Ni}$, chromium $x_{Cr}$, titanium $x_{Ti}$, carbon $x_C$, niobium $x_{Nb}$, tantalum $x_{Ta}$ and, when present, silicon $x_{Si}$ and manganese $x_{Mn}$, therefore satisfy both of the following relationships R3, R4:

$$-28.3x_{Al}^2+455.4x_{Al}-0.32x_{Ni}^2+15.3x_{Ni}-0.22x_{Cr}^2+20.7x_{Cr}+121x_{Si}+27x_{Mn}+16x_{Ti}+12x_{Nb}+16x_{Ta}-45x_C-866 \leq Ts, \quad (R3)$$

and $$1.8x_{Al}^2+38.3x_{Al}+0.42x_{Ni}^2-51.2x_{Ni}+27.8x_{Cr}+34x_{Si}+8x_{Mn}+89x_{Ti}+39x_{Nb}+22x_{Ta}-334x_C+1572 \leq Ts, \quad (R4)$$

where Ts represents the operating temperature.

In the field of steam cracking furnaces, the alloys forming the tubes can be subjected to temperatures ranging from 950° C. to 1150° C. For example, an operating temperature Ts of 1000° C. could be taken into account in the above relationships to cover a large number of industrial applications.

In the alloy according to the present disclosure, nickel is considered as the main stabilizing element and must be introduced in sufficient quantity to reduce the maximum temperatures $T_{max}^{B2\text{-}NiAl}$ and $T_{max}^{\alpha'}$ of the stability domain of the B2-NiAl and alpha prime phases. Nickel is also the major cost contributor and it is advantageous to keep its content to a minimum. Thus, according to another advantageous embodiment of the invention, the nickel weight percentage is defined from the previous relationships R3, R4, by solving the following second-degree equations E3, E4:

$$[-0.32\times(X')^2+15.3\times(X')+C']=0, \quad (E3)$$

wherein:

$$C'=-28.3x_{Al}^2+455.4x_{Al}-0.22x_{Cr}^2+20.7x_{Cr}+121x_{Si}+27x_{Mn}+16x_{Ti}+12x_{Nb}+16x_{Ta}-45x_C-866-Ts$$

$x_{Al}$, $x_{Cr}$, $x_{Si}$, $x_{Mn}$, $x_{Ti}$, $x_{Nb}$, $x_{Ta}$, $x_C$ are respectively the weight percentages of aluminum, chromium, silicon, manganese, titanium, niobium, tantalum and carbon, Ts represents the operating temperature.

If $[(15.3)^2+4\times0.32\times C']>0$, X' is then expressed as:

$$X'=[15.3+\sqrt{[(15.3)^2+4\times0.32\times C']}]/[\mathbf{2\times0.32}]$$

$$[0.42\times(X'')^2-51.2\times(X'')+C'']=0, \quad (E4)$$

wherein:

$$C''=1.8x_{Al}^2+38.3x_{Al}+27.8x_{Cr}+34x_{Si}+8x_{Mn}+89x_{Ti}+39x_{Nb}+22x_{Ta}-334x_C+1572-Ts$$

$x_{Al}$, $x_{Cr}$, $x_{Si}$, $x_{Mn}$, $x_{Ti}$, $x_{Nb}$, $x_{Ta}$, $x_C$ are respectively the weight percentages of aluminum, chromium, silicon, manganese, titanium, niobium, tantalum and carbon, Ts represents the operating temperature.

If $[(51.2)^2-4\times0.42\times C'']>0$, X" is then expressed as:

$$X''=[51.2-\sqrt{[(51.2)^2-4\times0.42\times C'']}]/[\mathbf{2\times0.42}]$$

The percentage of nickel $x_{Ni}$ is then chosen between X and X+10, with X the maximum value between:

30%, minimum Ni content of the alloy

X' and X".

X is a minimum value for the alloy to have very little or no B2-NiAl and alpha prime phases at the operating temperature Ts. An upper boundary is defined at X plus 10 points (X+10), to leave an industrial latitude on the control of the composition. More nickel does not provide any additional benefit and unnecessarily increases alloy costs. Alternatively, the upper boundary could be set to X+8 or even X+6.

For example, for an operating temperature Ts of 950° C. and an alloy comprising the following weight percentages of carbon, manganese, silicon, chromium, niobium, aluminum, titanium and yttrium:

| | Element | | | | | | | | | |
|---|---|---|---|---|---|---|---|---|---|---|
| | C | Mn | Si | Ni | Cr | Nb | Al | Ti | Y | Fe |
| Alloy weight % | 0.45 | 0.2 | 0.2 | xNi | 25 | 0.8 | 4 | 0.1 | 0.005 | Bal. |

one obtains:

X'=44.6 and X"=41.2

The nickel weight percentage $x_{Ni}$ according to this embodiment is therefore chosen between:

a minimum of X=44.6% (the value X, greater than 30%, consisting of the largest value between solutions X' and X" of equations E3 and E4)

and a maximum of X+10=54.6%.

The present disclosure also concerns a process for designing and forming an austenitic alloy with a high aluminum content and excellent corrosion and creep resistance at an operating temperature of 900° C. or more.

The design process according to the present disclosure applies to an austenitic alloy based on nickel, chromium and iron, and with a high aluminum content, intended for use at an operating temperature Ts between 900° and 1200° C., and comprising the following elements in weight percent:

chromium between 20% and 32%,
nickel between 30% and 60%,
aluminum between 3.5% and 6%,
carbon between 0.4% and 0.7%,
titanium between 0.05% and 0.3%,
niobium and/or tantalum between 0.6 and 2%,
an element, composed of at least one rare earth and/or of hafnium, between 0.002% and 0.1%,
silicon between 0 and 0.5%,
manganese between 0 and 0.5%,
tungsten between 0 and 2%,
iron as the balance of the elements in the alloy.

The design process includes the selection of the respective weight percentages of aluminum $x_{Al}$, nickel $x_{Ni}$, chromium $x_{Cr}$, titanium $x_{Ti}$, carbon $x_C$, niobium $x_{Nb}$, tantalum $x_{Ta}$, and if present, silicon $x_{Si}$, manganese $x_{Mn}$ and tungsten $x_W$, so that the alloy has less than 1%, or even less than 0.5%, or even less than 0.2% by volume of an intermetallic B2-NiAl phase and/or an alpha prime phase, after the operating temperature Ts has been applied to it for a few hours.

The presence of a very small volume fraction of B2-NiAl and alpha prime phases or the absence thereof in the alloy, after the operating temperature Ts has been applied to it, can be verified experimentally on a sample (e.g., by scanning electron or transmission electron microscopy).

According to an advantageous embodiment of the design process, the respective weight percentages of aluminum $x_{Al}$, nickel $x_{Ni}$, chromium $x_{Cr}$, titanium $x_{Ti}$, carbon $x_C$, niobium $x_{Nb}$, tantalum $x_{Ta}$, and if present, silicon $x_{Si}$ and manganese $x_{Mn}$, are chosen so as to satisfy both of the following relationships R3, R4:

$$-28.3x_{Al}^2+455.4x_{Al}-0.32x_{Ni}^2+15.3x_{Ni}-0.22x_{Cr}^2+20.7x_{Cr}+121x_{Si}+27x_{Mn}+16x_{Ti}+12x_{Nb}+16x_{Ta}-45x_C-866\leq Ts, \quad (R3)$$

and $$1.8x_{Al}^2+38.3x_{Al}+0.42x_{Ni}^2-51.2x_{Ni}+27.8x_{Cr}+34x_{Si}+8x_{Mn}+89x_{Ti}+39x_{Nb}+22x_{Ta}-334x_C+1572\leq Ts, \quad (R4)$$

where Ts represents the operating temperature.

According to an advantageous embodiment, the design process according to the disclosure makes it possible to define the nickel weight percentage $x_{Ni}$: this percentage is defined from the relations R3, R4 mentioned above, by solving the following equations of the second degree E3, E4:

$$[-0.32\times(X')^2+15.3\times(X')+C']=0, \quad (E3)$$

wherein:

$$C'=-28.3x_{Al}^2+455.4x_{Al}-0.22x_{Cr}^2+20.7x_{Cr}+121x_{Si}+27x_{Mn}+16x_{Ti}+12x_{Nb}+16x_{Ta}-45x_C-866-Ts$$

$x_{Al}$, $x_{Cr}$, $x_{Si}$, $x_{Mn}$, $x_{Ti}$, $x_{Nb}$, $x_{Ta}$, $x_C$ are respectively the weight percentages of aluminum, chromium, silicon, manganese, titanium, niobium, tantalum and carbon, Ts represents the operating temperature.

When $[(15.3)^2+4\times0.32\times C']>0$, X' is then expressed as:

$$X'=[15.3+\sqrt{[(15.3)^2+4\times0.32\times C']}]/[\mathbf{2\times0.32}]$$

$$[0.42\times(X'')^2-51.2\times(X'')+C'']=0, \quad (E4)$$

wherein:

$$C''=1.8x_{Al}^2+38.3x_{Al}+27.8x_{Cr}+34x_{Si}+8x_{Mn}+89x_{Ti}+39x_{Nb}+22x_{Ta}-334x_C+1572-Ts$$

$x_{Al}$, $x_{Cr}$, $x_{Si}$, $x_{Mn}$, $x_{Ti}$, $x_{Nb}$, $x_{Ta}$, $x_C$ are respectively the weight percentages of aluminum, chromium, silicon, manganese, titanium, niobium, tantalum and carbon, Ts represents the operating temperature.

When $[(51.2)^2-4\times0.42\times C'']>0$, X" is then expressed as:

$$X''=[51.2-\sqrt{[(51.2)^2-4\times0.42C'']}]/[\mathbf{2\times0.42}]$$

The percentage of nickel $x_{Ni}$ is then chosen between X and X+10, with X the maximum value between:

30%, minimum Ni content of the alloy
X'
and X".

X is a minimum value for the alloy to have very little or no B2-NiAl and alpha prime phases at the operating temperature Ts. An upper boundary is defined at X+10 because more nickel does not provide any additional benefit and unnecessarily increases alloy costs; the upper boundary could possibly be set at X+8 or even X+6.

As stated above, in the field of steam cracking furnaces, the alloys forming the tubes are usually subjected to temperatures ranging from 950° C. to 1150° C. Operating temperatures Ts of 950° C., 1000° C. or 1050° C. can be the most commonly considered.

The present disclosure also concerns a process for validating the compatibility of an austenitic alloy with a high aluminum content, with an operating temperature Ts defined between 900° C. and 1200° C. A compatible alloy is an alloy with excellent corrosion and creep resistance at or above the operating temperature Ts.

The validation process according to the present disclosure applies to an austenitic alloy based on nickel, chromium and iron, and having a high aluminum content, intended for use at or above operating temperature Ts, and comprising the following elements in weight percent:

chromium between 20% and 32%,
nickel between 30% and 60%,
aluminum between 3.5% and 6%,
carbon between 0.4% and 0.7%,
titanium between 0.05% and 0.3%,
niobium and/or tantalum between 0.6 and 2%,
an element, composed of at least one rare earth and/or of hafnium, between 0.002% and 0.1%,
silicon between 0 and 0.5%,
manganese between 0 and 0.5%,
tungsten between 0 and 2%,
iron as the balance of the elements in the alloy.

The validation process includes checking that the alloy is free or has less than 1%, or even less than 0.5%, or even less than 0.2% by volume of B2-NiAl and alpha prime intermetallic phases after the operating temperature Ts has been applied to it for a few hours (typically 10 hours).

The presence of a very small volume fraction of the B2-NiAl and alpha prime phases or the absence thereof in the alloy, after the operating temperature has been applied to it, can be verified experimentally on a sample (e.g., by scanning electron or by transmission electron microscopy).

According to an advantageous embodiment of the validation process, the respective weight percentages of aluminum $x_{Al}$, nickel $x_{Ni}$, chromium $x_{Cr}$, titanium $x_{Ti}$, carbon $x_C$, niobium $x_{Nb}$, tantalum $x_{Ta}$ and, if present, silicon $x_{Si}$ and manganese $x_{Mn}$, in the alloy are measured (e.g., by spark spectrometry); the following relationships are then applied in order to verify the compatibility of the alloy with a determined operating temperature Ts:

$$-28.3x_{Al}^2+455.4x_{Al}-0.32x_{Ni}^2+15.3x_{Ni}-0.22x_{Cr}^2+20.7x_{Cr}+121x_{Si}+27x_{Mn}+16x_{Ti}+12x_{Nb}+16x_{Ta}-45x_C-866\leq Ts \quad (R3)$$

$$1.8x_{Al}^2+38.3x_{Al}+0.42x_{Ni}^2-51.2x_{Ni}+27.8x_{Cr}+34x_{Si}+8x_{Mn}+89x_{Ti}+39x_{Nb}+22x_{Ta}-334x_C+1572\leq Ts \quad (R4)$$

If the inequality is satisfied for both relationships R3, R4, the alloy is compatible with the determined operating temperature Ts. If at least one inequality is not satisfied, the alloy is identified as not compatible with the determined operating temperature Ts; the alloy could potentially be identified as compatible with a higher operating temperature Ts.

TESTS AND EXAMPLES

The examples of alloys described below have a high aluminum content (greater than 3.5%), their high environmental resistance has been verified and is considered assured.

As an example, operating temperatures Ts of 950° C., 1000° C. and 1050° C. are considered, in order to demonstrate the variation that can be seen over this range and to frame the most common operating temperatures used in the application of steam cracking.

Figures 1, 2A:
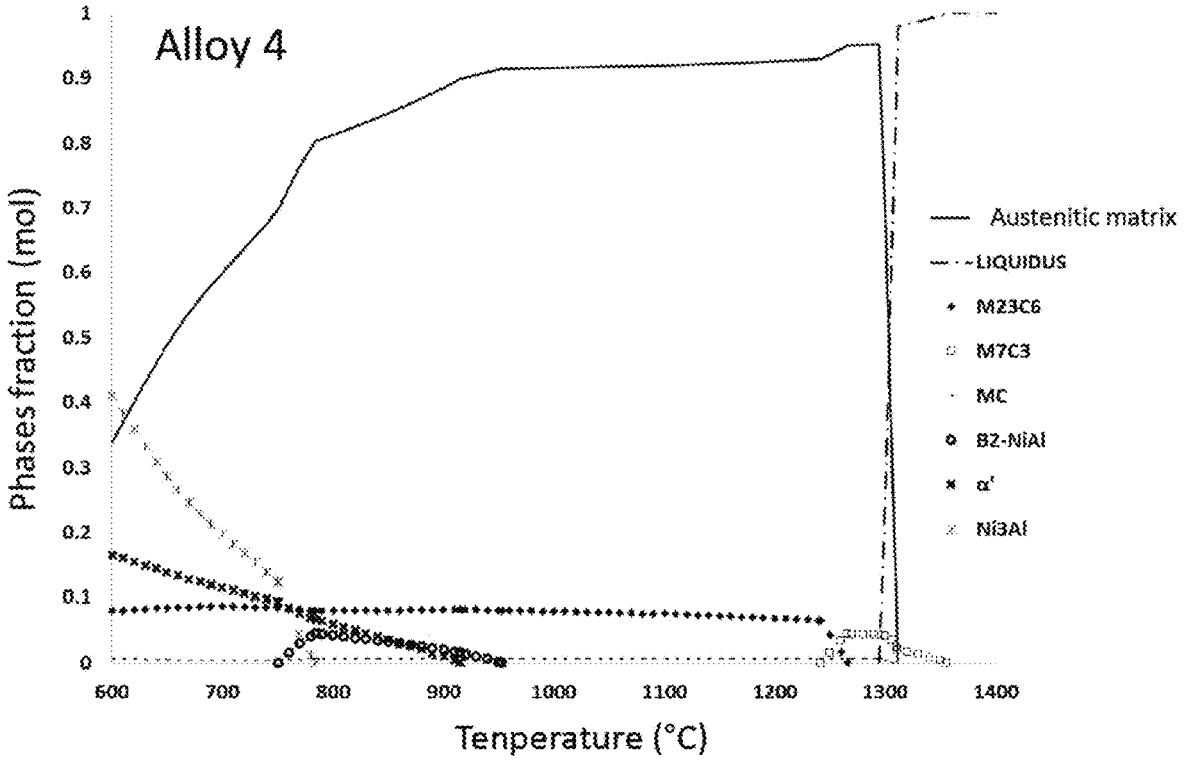
FIG. 1 is a table showing the composition of alloys tested within the framework of this disclosure.
FIGS. 2A to 2D present phase diagrams, derived from simulations, for four alloys tested within the framework of this disclosure.
Figure 2B:
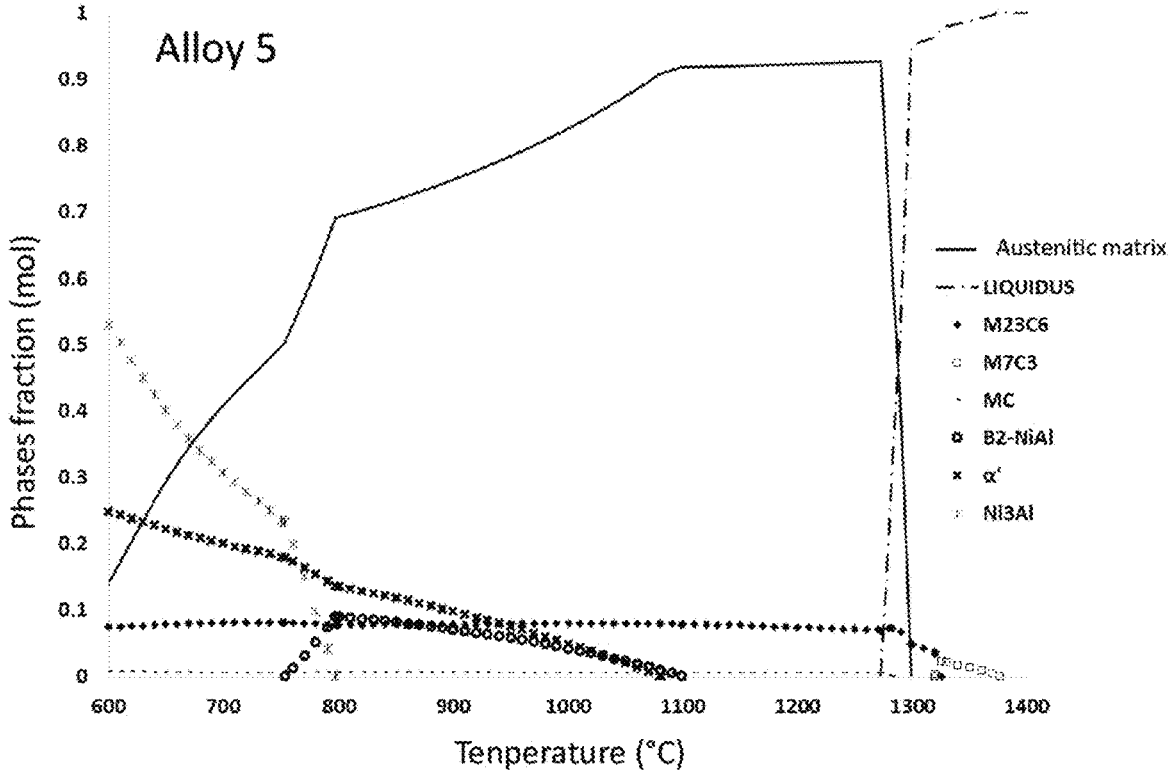
Figure 2C:
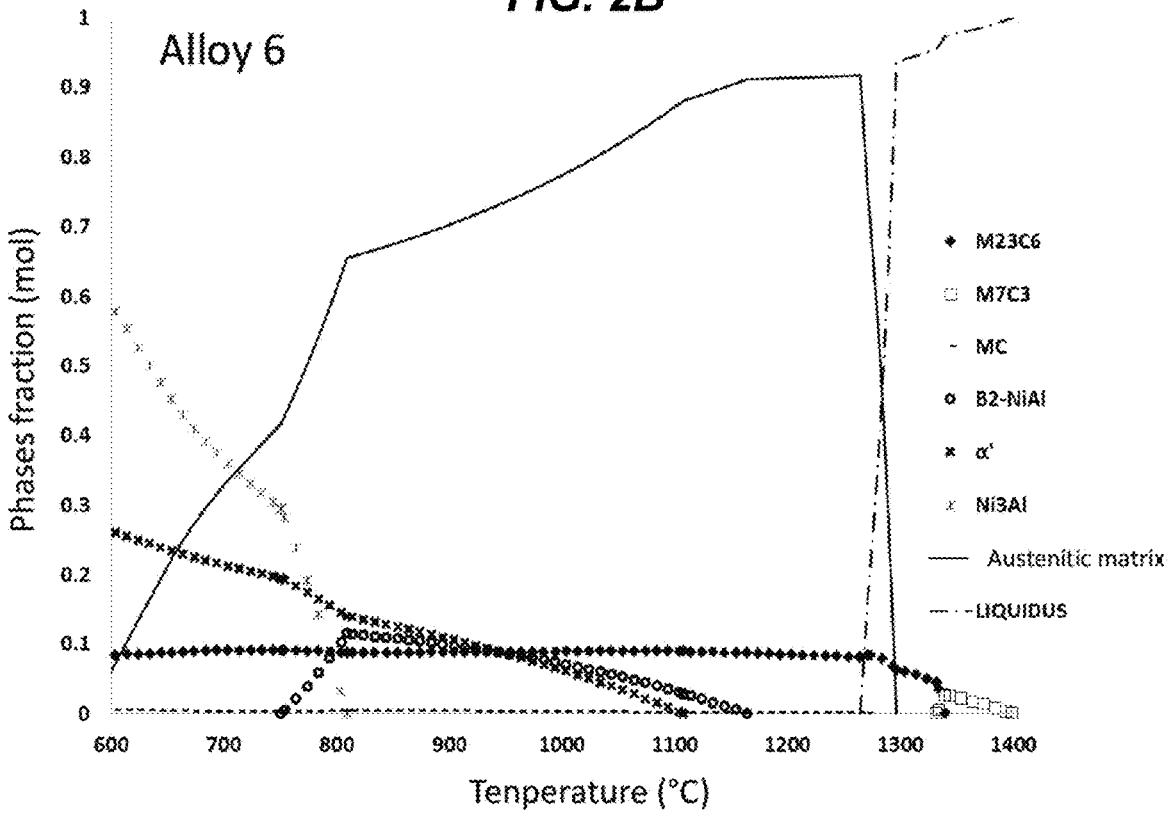
Figure 2D:
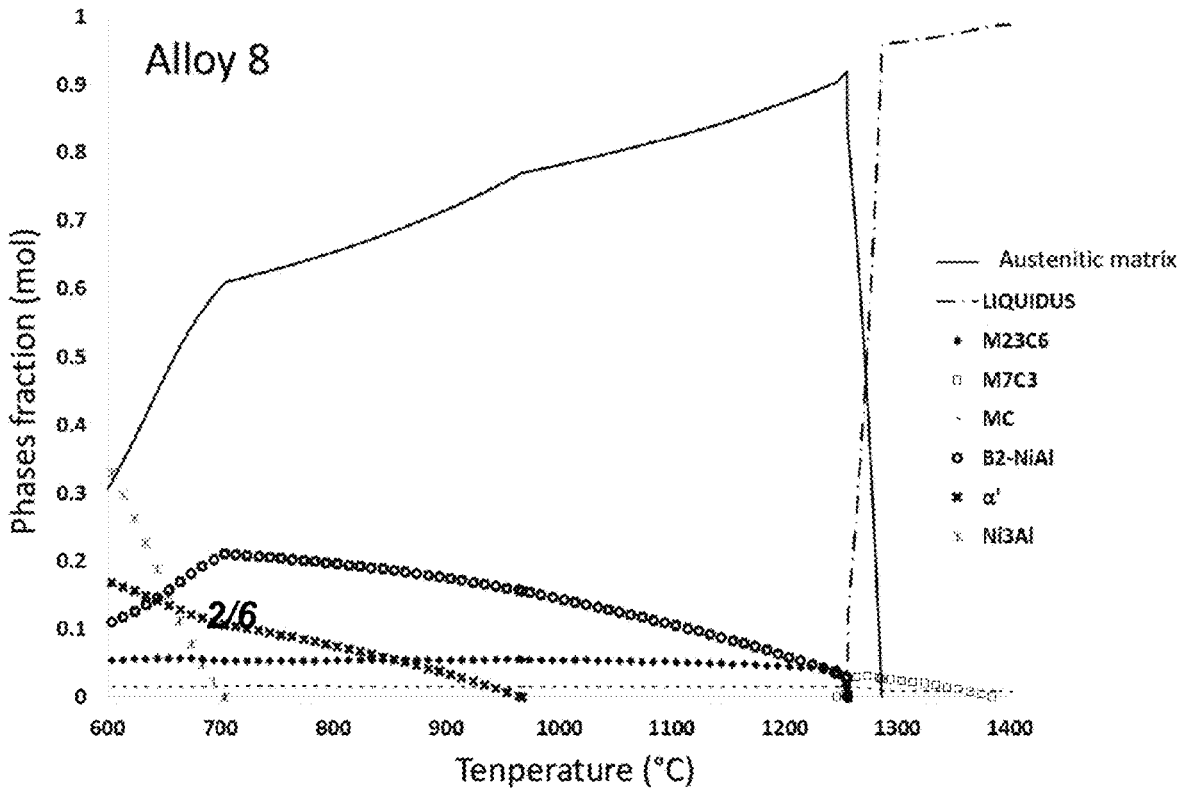

The creep resistance of the alloys shown in the examples (Table 1 in FIG. 1) was evaluated from creep tests at 1050° C., under a constant stress of 17 MPa, the tests being carried out on samples taken from parts made from the different alloys. From these tests, a deformation curve (percentage of sample deformation) as a function of time is plotted, and a time to rupture $t_R$ is obtained, i.e., the time necessary to break the sample.

The time to rupture $t_R$ of the individual samples is compared to the time to rupture $t_{Ref}$ of a nickel, chromium and iron-based alloy known and used for petrochemical steam cracking applications, whose trade name is MANAURITE® XTM.

The composition of the alloys numbered from 1 to 8 is detailed in Table 1. The composition of the MANAURITE® XTM reference alloy, noted as "Ref," is also included in Table 1. The time to rupture $t_{Rref}$ of the reference alloy under the considered creep test conditions is 1095 hours. The strength of an alloy in these examples is therefore considered very good if the rupture time $t_R$ is in the same range of values, i.e., greater than or equal to 1000 h.

Alloys referenced 1 to 8 in Table 1 include weight percentages of aluminum ranging from 3.5% to 5.6%. The other elements of each alloy 1 to 8 have weight percentages within the ranges set out above for an alloy according to the present disclosure, as shown in Table 1.

The maximum temperature values $T_{max}^{B2\text{-}NiAl}$ and $T_{max}^{\alpha'}$ of the stability domain of the intermetallic B2-NiAl and alpha prime phases, i.e., the temperatures below which the phases occur, can be calculated from the weight percentages of the elements aluminum, nickel, chromium, titanium, carbon, niobium, tantalum and, when present, silicon and manganese, according to the R1,R2 relationships established by the applicant:

$$T_{max}^{B2\text{-}NiAl}(°\text{ C.})=-28.3x_{Al}^2+455.4x_{Al}-0.32x_{Ni}^2+15.3x_{Ni}-0.22x_{Cr}^2+20.7x_{Cr}+121x_{Si}+27x_{Mn}+16x_{Ti}+12x_{Nb}+16x_{Ta}-45x_C-866, \quad (R1)$$

and $$T_{max}^{\alpha'}(°\text{ C.})=1.8x_{Al}^2+38.3x_{Al}+0.42x_{Ni}^2-51.2x_{Ni}+27.8x_{Cr}+34x_{Si}+8x_{Mn}+89x_{Ti}+39x_{Nb}+22x_{Ta}-334x_C+1572. \quad (R2)$$

These maximum temperatures $T_{max}^{B2\text{-}NiAl}$ and $T_{max}^{\alpha'}$ also appear on the phase diagrams from CALPHAD simulations shown in FIGS. 2A to 2D: the stability domain of the B2-NiAl phase is represented by the curve indicated by hollow round symbols, the stability domain of the alpha-prime phase is represented by the curve indicated by black crossed symbols.

Alloys 1 to 8 have a maximum temperature $T_{max}^{B2\text{-}NiAl}$ of 822.1° C., 906° C., 1079.6° C., 961.9° C., 1127.8° C., 1175.2° C., 988.2° C., 1255.2° C. and a maximum temperature $T_{max}^{\alpha'}$ of 878.6° C., 895° C., 1158.3° C., 907.1° C., 1098.4° C., 1120.1° C., 858.7° C., 961.2° C. respectively.

For an operating temperature of 950° C., alloys 1 and 2 satisfy both relationships $T_{max}^{B2\text{-}NiAl}\leq Ts$ and $T_{max}^{\alpha'}\leq Ts$, and, therefore, do not have B2-NiAl and alpha prime phases at the operating temperature Ts and are in accordance with the present disclosure. Alloys 3, 4, 5, 6, 7 and 8 do not satisfy the two above-mentioned relationships, and are therefore not in conformity with the present disclosure, for an operating temperature of 950° C.

For an operating temperature of 1000° C. or 1050° C., alloys 1, 2, 4 and 7 satisfy both relationships $T_{max}^{B2\text{-}NiAl}\leq Ts$ and $T_{max}^{\alpha'}\leq Ts$, and are in accordance with the present disclosure.

Figure 3A:
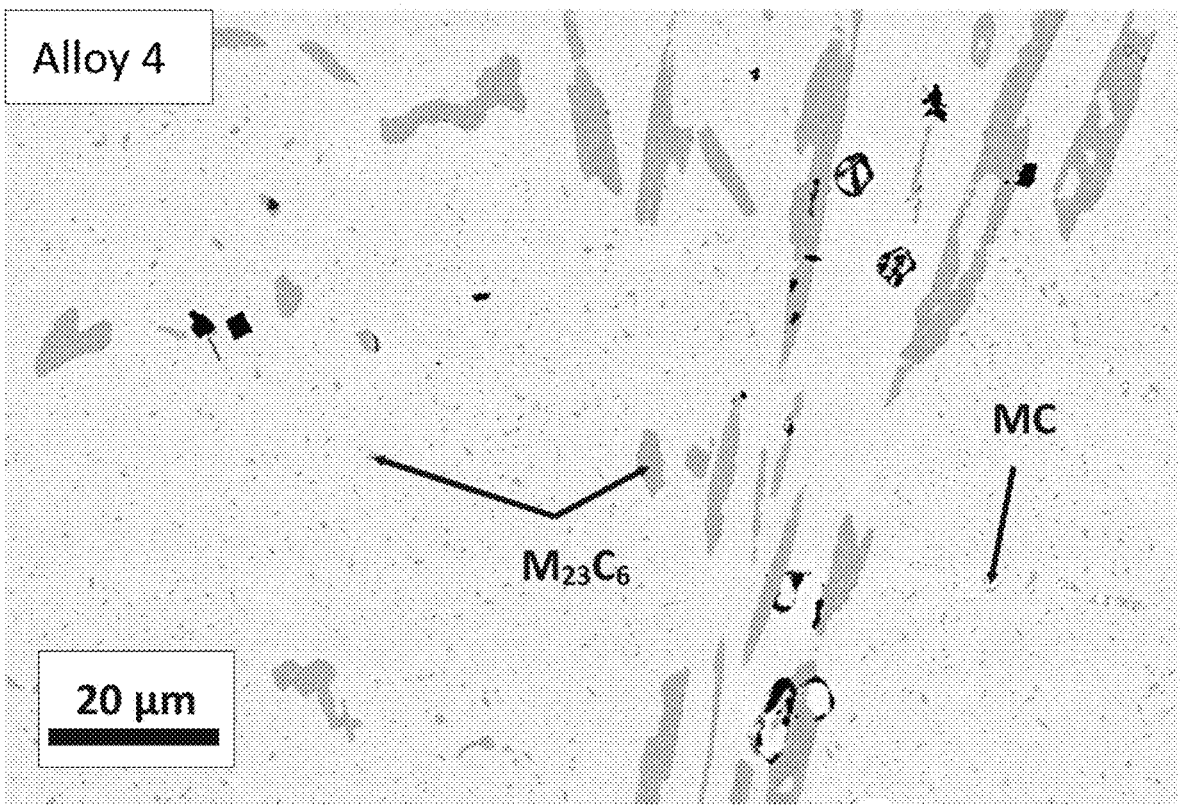
FIGS. 3A to 3D show scanning electron microscopy (SEM) images of four alloys tested within the framework of this disclosure.

FIG. 3A shows that alloy 4 (sample from the creep test at 1050° C., characterized physically after the test, by way of example) does not have a B2-NiAl intermetallic phase or an alpha prime phase after it has been subjected to a temperature of 1050° C. Only the classical phases are observed: $M_{23}C_6$ carbides in an austenitic matrix. The initial interdendritic primary carbides $M_7C_3$ were transformed into secondary carbides $M_{23}C_6$, accompanied by a finely dispersed precipitation of secondary carbides $M_{23}C_6$ (black zones).

Figure 4:
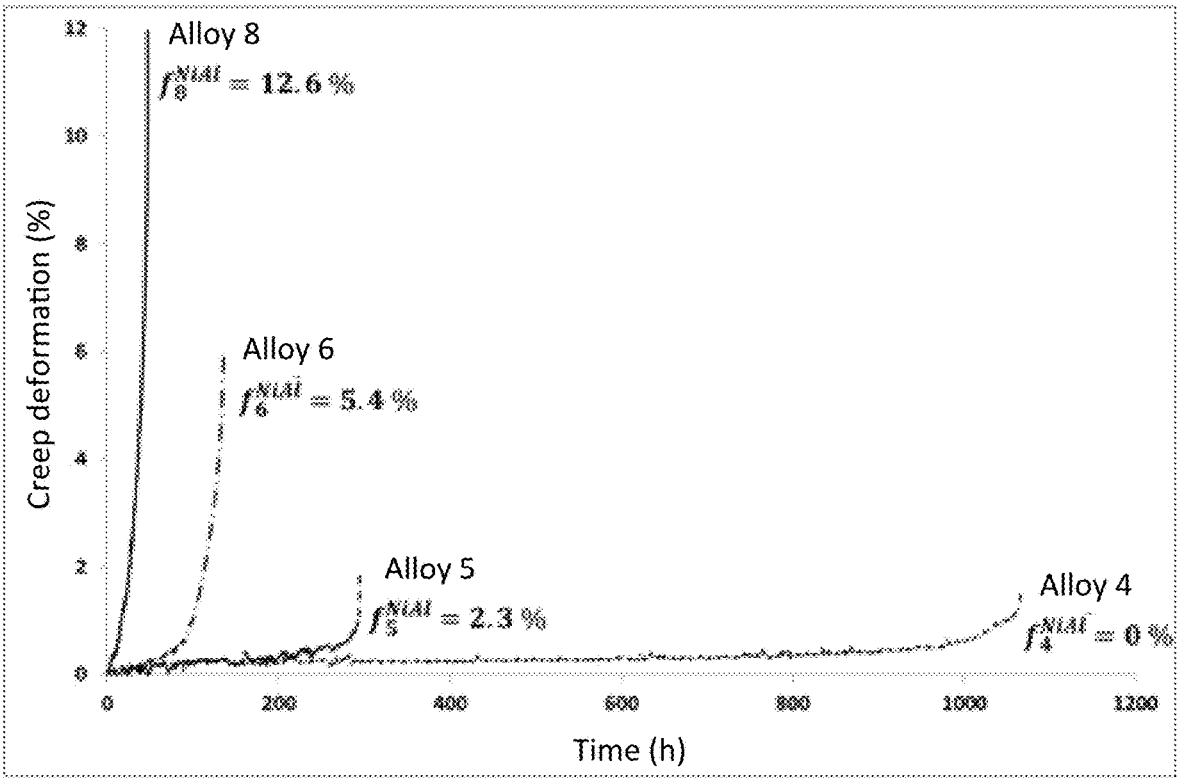
FIG. 4 shows creep curves at 1050° C. under a stress of 17 MPa for four alloys tested within the framework of this disclosure.

Alloys 1, 2, 4 and 7 have rupture times $t_R$ between 1000 h and 1351 h (Table 1), which corresponds to an excellent creep resistance. FIG. 4 shows the deformation of a sample of alloy 4 during the creep test as a function of time. The alloy 4 according to the present disclosure, for an operating temperature Ts of 1050° C., undergoes only a very slight deformation at 1050° C. under stress for at least the first 1000 hours.

Alloys 3, 5, 6 and 8 do not satisfy either of the two relationships $T_{max}^{B2\text{-}NiAl}\leq Ts$ and $T_{max}^{\alpha'}\leq Ts$, and do not conform to the present disclosure for an operating temperature of 1000° C. or 1050° C.

Figure 3B:
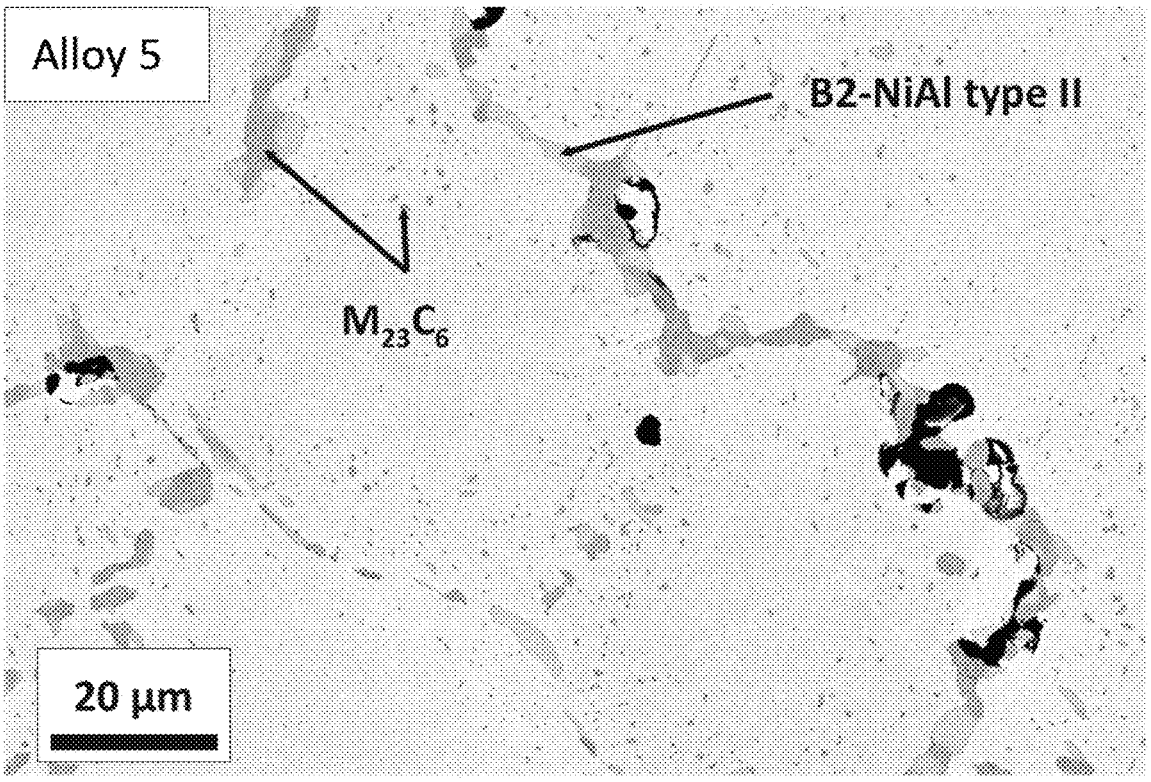
Figure 3C:
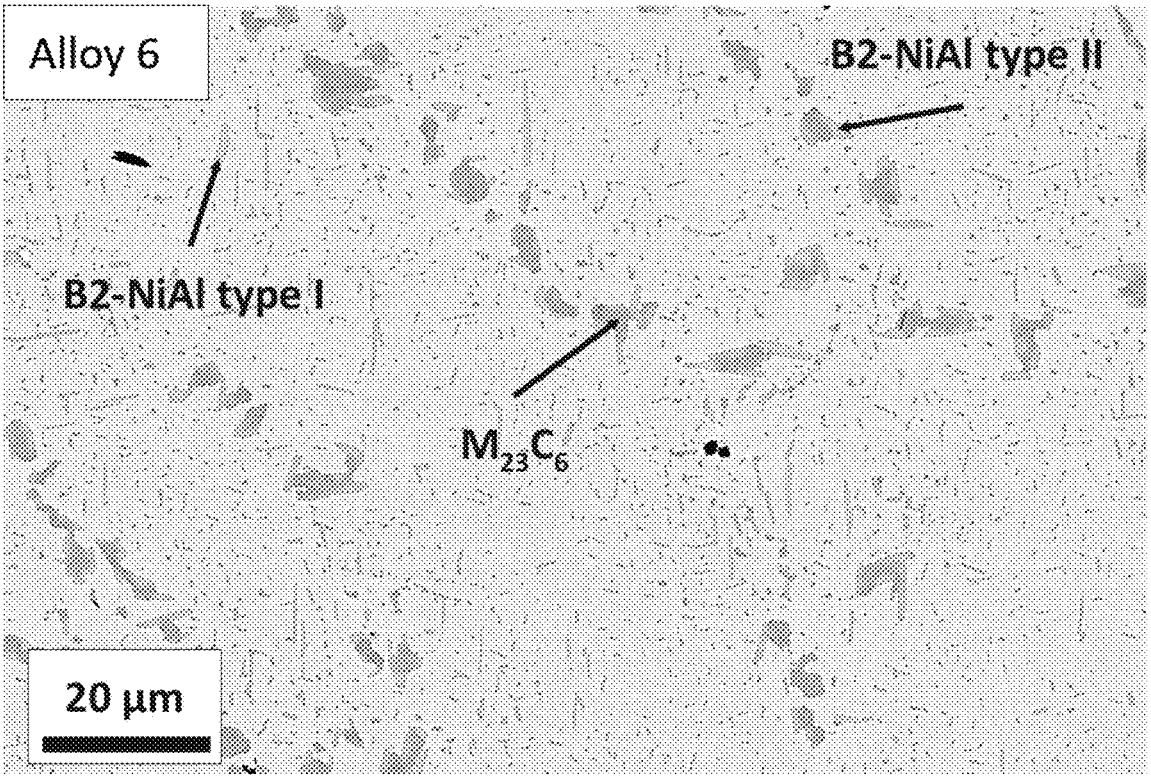
Figure 3D:
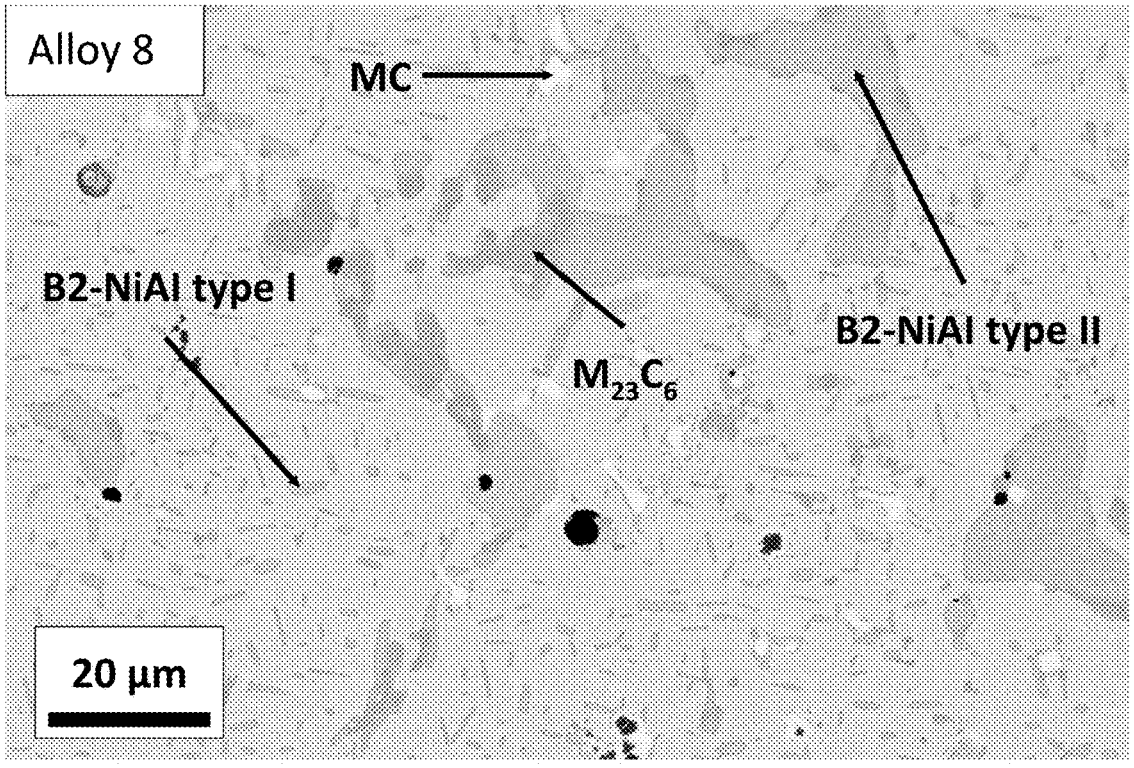

FIGS. 3B, 3C and 3D show respectively that alloys 5, 6 and 8 (samples from the creep test at 1050° C., characterized physically after the test, by way of example) have B2-NiAl precipitates after they have been subjected to a temperature of 1050° C. This B2-NiAl intermetallic phase could be identified as such thanks to fine characterizations carried out by transmission electron microscopy (TEM). The B2-NiAl phase appeared as two different types in alloys 6 (FIG. 3C) and 8 (FIG. 3D): a type I having a flat shape in the austenitic matrix, formed by homogeneous germination; and a type II present between the carbide precipitates and the austenitic matrix, formed by heterogeneous germination. It should be noted that the alpha prime phase rich in chromium was also identified by TEM, precipitating mainly at B2-NiAl/matrix interfaces and in the form of nanoprecipitates in the B2-NiAl phase.

It can be noted that alloys 3, 5, 6 and 8 have times to rupture $t_R$ between 47 h and 500 h, which corresponds to a mechanical strength much lower than the targeted reference value. FIG. 4 shows the deformation of a sample of each of alloys 5, 6 and 8 during the creep test as a function of time. They undergo significant deformation at 1050° C. under stress during the first 250 hours.

To have good creep resistance at a given operating temperature Ts, the austenitic alloy with a high aluminum content according to the present disclosure must include the stated elements, at weight percentages within the stated ranges, and contain only a small volume fraction (less than or equal to 1%) or not at all of the intermetallic B2-NiAl and alpha prime phases, after the determined operating temperature Ts has been applied.

The relationships R1, R2, R3, R4 established by the applicant between the maximum temperatures $T_{max}^{B2\text{-}NiAl}$ and $T_{max}^{\alpha'}$ of the stability domains of the B2-NiAl intermetallic phase and the alpha prime phase respectively, and the weight percentages of the aluminum, nickel, chromium, titanium, carbon, niobium, tantalum, silicon and manganese elements, make it possible to predict, for a given alloy composition (within the limits of the ranges stated), whether the alloy composition can exhibit a high creep resistance at a given operating temperature Ts.

The relationships established by the applicant also make it possible, advantageously, to choose the nickel weight percentage according to the other alloy elements and the operating temperature Ts, within a range ensuring the high creep resistance of the alloy while limiting unnecessary costs of too large a quantity of this element.

Austenitic alloys according to the present disclosure can find applications in the field of petrochemical industry (steam cracking furnaces), in any other high temperature application, typically greater than or equal to 900° C. combining environmental and creep resistance issues.

Of course, the invention is not limited to the described embodiments, and alternative embodiments can be provided without departing from the scope of the invention as defined by the claims.

What is claimed is:

1. An austenitic alloy based on nickel, chromium and iron, and having a high aluminum content, for use at a given operating temperature (Ts) between 900° C. and 1200° C., the alloy comprising the following elements, in weight percent:

chromium in a range extending from greater than 23% to 26%,
nickel between 30% and 60%,
aluminum between 3.5% and 6%,
carbon between 0.4% and 0.7%,
titanium between 0.05% and 0.3%,
niobium and/or tantalum between 0.6% and 2%,
an element, composed of at least one rare earth and/or of hafnium, between 0.002% and 0.1%,
silicon between 0 and 0.5%,
manganese between 0 and 0.5%,
tungsten between 0 and 2%,
iron as a balance of the elements in the alloy;

wherein the alloy has a molar fraction of primary carbides of M7C3 higher than about 0.02 and a molar fraction of primary carbides of M23C6 lower than about 0.01 after solidification of the alloy, and wherein the alloy has less than 1% by volume of an intermetallic B2-NiAl phase and less than 1% by volume of an alpha prime chromium-rich phase, after subjecting the alloy to the operating temperature (Ts).

2. The austenitic alloy of claim 1, wherein the weight percentages of aluminum $x_{Al}$, nickel $x_{Ni}$, chromium $x_{Cr}$, titanium $x_{Ti}$, carbon $x_C$, niobium $x_{Nb}$, tantalum $x_{Ta}$, silicon $x_{Si}$ and manganese $x_{Mn}$ satisfy the two following relationships (R3, R4):

$$-28.3x_{Al}^2+455.4x_{Al}-0.32x_{Ni}^2+15.3x_{Ni}-0.22x_{Cr}^2+20.7x_{Cr}+121x_{Si}+27x_{Mn}+16x_{Ti}+12x_{Nb}+16x_{Ta}-45x_C-866\leq 1000°\text{ C., and} \quad \text{(R3)}$$

$$1.8x_{Al}^2+38.3x_{Al}+0.42x_{Ni}^2-51.2x_{Ni}+27.8x_{Cr}+34x_{Si}+8x_{Mn}+89x_{Ti}+39x_{Nb}+22x_{Ta}-334x_C+1572\leq 1000°\text{ C.} \quad \text{(R4)}$$

3. The austenitic alloy of claim 2, wherein the weight percentage of nickel $x_{Ni}$ is defined by solving second degree equations (E3, E4) resulting from the relationships (R3, R4).

4. The austenitic alloy of claim 3, wherein the weight percentage of nickel $x_{Ni}$ is between a value (X), greater than 30%, consisting of the largest value between solutions (X', X") of the equations (E3, E4), and a value X plus ten (X+10).

5. The austenitic alloy of claim 4, wherein the sum of the percentages of niobium and tantalum is greater than 0.6% and less than or equal to 2%.

6. The austenitic alloy of claim 5, wherein the weight percentage of aluminum in the alloy is greater than 3.8%.

7. The austenitic alloy of claim 6, wherein the weight percentage of aluminum in the alloy is greater than 4%.

8. The austenitic alloy of claim 7, wherein the total weight percentage of rare earths and/or hafnium in the alloy is between 0.002% and 0.05%.

9. The austenitic alloy of claim 1, wherein the sum of the percentages of niobium and tantalum is greater than 0.6% and less than or equal to 2%.

10. The austenitic alloy of claim 1, wherein the weight percentage of aluminum in the alloy is greater than 3.8%.

11. The austenitic alloy of claim 1, wherein the total weight percentage of rare earths and/or hafnium in the alloy is between 0.002% and 0.05%.

12. A method of forming an austenitic alloy based on nickel, chromium and iron, and having a high aluminum content, for use at a given operating temperature (Ts) between 900° C. and 1200° C., and comprising alloying the following elements, in weight percent:

chromium in a range extending from greater than 23% to 26%,
nickel between 30% and 60%,
aluminum between 3.5% and 6%,
carbon between 0.4% and 0.7%,
titanium between 0.05% and 0.3%,
niobium and/or tantalum between 0.6 and 2%,
an element, composed of at least one rare earth and/or of hafnium, between 0.002% and 0.1%,
silicon between 0 and 0.5%,
manganese between 0 and 0.5%,
tungsten between 0 and 2%,
iron to balance the elements in the alloy;
wherein the alloy has a molar fraction of primary carbides of M7C3 higher than about 0.02 and a molar fraction of primary carbides of M23C6 lower than about 0.01 after solidification of the alloy, the method comprising selecting the respective weight percentages of aluminum $x_{Al}$, nickel $x_{Ni}$, chromium $x_{Cr}$, titanium $x_{Ti}$, carbon $x_C$, niobium $x_{Nb}$, tantalum $x_{Ta}$, silicon $x_{Si}$ and manganese $x_{Mn}$, so that the alloy has less than 1% by volume of an intermetallic B2-NiAl phase and less than 1% by volume of an alpha prime phase rich in chromium, after subjecting the alloy to the operating temperature (Ts).

13. The method of claim 12, wherein the weight percentages of aluminum $x_{Al}$, nickel $x_{Ni}$, chromium $x_{Cr}$, titanium $x_{Ti}$, carbon $x_C$, niobium $x_{Nb}$, tantalum $x_{Ta}$, silicon $x_{Si}$ and manganese $x_{Mn}$ satisfy the two following relationships (R3, R4):

$$-28.3x_{Al}^2+455.4x_{Al}-0.32x_{Ni}^2+15.3x_{Ni}-0.22x_{Cr}^2+20.7x_{Cr}+121x_{Si}+27x_{Mn}+16x_{Ti}+12x_{Nb}+16x_{Ta}-45x_C-866\leq 1000°\text{ C., and} \quad \text{(R3)}$$

$$1.8x_{Al}^2+38.3x_{Al}+0.42x_{Ni}^2-51.2x_{Ni}+27.8x_{Cr}+34x_{Si}+8x_{Mn}+89x_{Ti}+39x_{Nb}+22x_{Ta}-334x_C+1572\leq 1000°\text{ C.} \quad \text{(R4)}$$

14. The method of claim 13, wherein the nickel weight percentage $x_{Ni}$ is defined by solving second degree equations (E3, E4) resulting from the relationships (R3, R4), and wherein the nickel weight percentage $x_{Ni}$ is between a value (X), greater than 30%, consisting of the largest value between solutions (X', X") of the equations (E3,E4), and a value increased by ten (X+10).

15. The method of claim 14, wherein the weight percentage of aluminum in the alloy is greater than 3.8%.

16. The method of claim 12, wherein the weight percentage of aluminum in the alloy is greater than 3.8%.

* * * * *